US010103498B2

(12) United States Patent
Maesoba et al.

(10) Patent No.: US 10,103,498 B2
(45) Date of Patent: Oct. 16, 2018

(54) SHIELD CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hiroyoshi Maesoba, Mie (JP); Toshifumi Ichio, Mie (JP)

(73) Assignees: Autonetworks Technologies, LTD., Yokkaichi Mie (JP); Sumitomo Wiring Systems, LTD., Yokkaichi Mie (JP); Sumitomo Electric Industries, LTD., Osaka-shi, Osaka (JP)

( * ) Notice: Subject to any disclaimer, the term of this patent is extended or adjusted under 35 U.S.C. 154(b) by 0 days.

(21) Appl. No.: 15/541,509

(22) PCT Filed: Jan. 19, 2016

(86) PCT No.: PCT/JP2016/051356
§ 371 (c)(1),
(2) Date: Jul. 5, 2017

(87) PCT Pub. No.: WO2016/121566
PCT Pub. Date: Aug. 4, 2016

(65) Prior Publication Data

US 2018/0019547 A1 Jan. 18, 2018

(30) Foreign Application Priority Data

Jan. 29, 2015 (JP) ..... 2015-015442

(51) Int. Cl.
*H01R 9/03* (2006.01)
*H01R 13/648* (2006.01)
(Continued)

(52) U.S. Cl.
CPC ..... *H01R 13/648* (2013.01); *H01R 9/032* (2013.01); *H01R 13/516* (2013.01);
(Continued)

(58) Field of Classification Search
CPC ..... H01R 13/648; H01R 9/035
(Continued)

(56) References Cited

U.S. PATENT DOCUMENTS 5,273,459 A * 12/1993 Davis ..... H01R 13/6593 439/607.48
5,425,657 A * 6/1995 Davis ..... H01R 4/2433 439/405
(Continued)

FOREIGN PATENT DOCUMENTS

JP 10-162902 6/1998
JP 11-329573 11/1999
(Continued)

OTHER PUBLICATIONS

International Search Report dated Mar. 22, 2016.

*Primary Examiner* — Tulsidas C Patel
*Assistant Examiner* — Peter G Leigh
(74) *Attorney, Agent, or Firm* — Gerald E. Hespos; Michael J. Porco; Matthew T. Hespos

(57) ABSTRACT

A shield connector includes a shielded cable (11) with wires (12) enclosed by a shield layer (13). An inner housing (16) accommodates terminals (15) connected to the wires (12). A shield shell (20) covers the inner housing (16) and includes a connecting portion (23) to be connected electrically to the shield layer (13). An outer housing (30) accommodates the shield shell (20) and is locked to a mating connector. The outer housing (30) includes a body (31) enabling the shield shell (20) to be inserted therein through an opening (31A) on a rear side, and two covers (40A, 40B) integrally hinged to
(Continued)

the body (31) to close the opening (31A) and cover the connecting portion (23). Each cover (40A, 40B) includes a first lock (43, 44) to be locked to the mating cover and a second lock (45) to be locked to the body.

4 Claims, 12 Drawing Sheets

(51) Int. Cl.
*H01R 13/516* (2006.01)
*H01R 13/52* (2006.01)
*H01R 13/658* (2011.01)

(52) U.S. Cl.
CPC ..... *H01R 13/5202* (2013.01); *H01R 13/5205* (2013.01); *H01R 13/65802* (2013.01); *H01R 13/5208* (2013.01)

(58) Field of Classification Search
USPC ..... 439/607.44, 607.5, 607.03, 607.48, 439/607.56
See application file for complete search history.

(56) References Cited

U.S. PATENT DOCUMENTS 5,683,269 A * 11/1997 Davis ..... H01R 13/582 439/607.5
6,224,423 B1 * 5/2001 Yip ..... H01R 4/2429 439/607.08
6,629,858 B2 * 10/2003 Lo ..... H01R 9/035 439/108
6,659,801 B2 * 12/2003 Nishio ..... H01R 13/6581 439/607.48
6,913,489 B2 * 7/2005 Chai ..... H01R 13/5804 439/607.54
7,371,111 B2 * 5/2008 McCarthy ..... H01R 9/0503 439/578
7,785,118 B2 * 8/2010 McCarthy ..... H01R 9/0518 439/578
8,057,258 B2 * 11/2011 Kawaguchi ..... H01R 9/035 439/585
8,298,922 B2 * 10/2012 Schumann ..... H01R 13/5829 438/467
8,376,779 B2 * 2/2013 Metral ..... H01R 13/502 439/607.41
8,870,596 B2 * 10/2014 Ii ..... H01R 13/6581 439/607.41
9,531,132 B2 * 12/2016 Iwamoto ..... H01R 13/6581
2010/0015844 A1 * 1/2010 De Dios Martin .. H01R 4/2433 439/395
2010/0136832 A1 * 6/2010 Kawaguchi ..... H01R 9/035 439/607.03
2011/0081803 A1 * 4/2011 Kawaguchi ..... H01R 9/035 439/607.5

FOREIGN PATENT DOCUMENTS

JP 2000-182711 6/2000
JP 2010-21046 1/2010
JP 2010182647 A * 8/2010 ..... H01R 9/035
JP 2012-195315 10/2012

* cited by examiner

SHIELD CONNECTOR

BACKGROUND

1. Field of the Invention

The invention relates to a shield connector.

2. Description of the Related Art

Japanese Unexamined Patent Publication No. 2012-195315 is an example of a known shield connector for communication, and typically is mounted in a vehicle, such as an automotive vehicle. The connector is arranged in a wired communication path between an in-vehicle electrical component (car navigation system, ETC, monitor or the like) and an external device (camera or the like) or between in-vehicle electrical components in a vehicle. Such a shield connector includes an inner housing with cavities, and connection terminals are accommodated in the cavities for connecting mating terminals and signal wires. The inner housing is shielded collectively by a shield shell and the shield shell is connected electrically to a shield conductor of a shielded cable.

Further, it is proposed to provide an outer housing outside the shield shell and reliably connect the connection terminals and the mating terminals by locking this outer housing to a mating housing. The outer housing is, for example, configured to include a shell accommodating chamber in the form of a rectangular tube capable of accommodating the shield shell inside and an opening provided on a rear side of the shell accommodating chamber (rear side in a connecting direction to a mating connector) and enabling the shield shell to be inserted into the shell accommodating chamber. This opening is covered with a cover that can be integrated with the outer housing via a hinge. Thus the assembling operability of the shield connector can be improved and the number of components can be reduced.

However, in this configuration, the hinge may be broken and the cover may be detached from the outer housing, such as when the cover is repeatedly opened and closed for maintenance and the like.

The invention was completed based on the above situation and aims to provide a shield connector suppressing the detachment of a cover even if a hinge is broken.

SUMMARY

A shield connector disclosed in this specification includes a shielded cable with wires collectively enclosed by a shield layer and an insulation coating covering an outer periphery of the shield layer. The shield connector further includes an inner housing configured to accommodate terminals connected to the wires inside. A shield shell covers the inner housing and includes a connecting portion to be electrically connected to the shield layer of the shielded cable exposed on an end part, and an outer housing configured to accommodate the shield shell inside and to be locked to a mating connector. The outer housing includes a body portion enabling the shield shell to be inserted therein through an opening on a rear side in a connecting direction to the mating connector, and two covers integrally provided to the body via hinges and configured to close the opening and to cover the connecting portion. Each of the covers includes a first locking means to be locked to the mating cover and a second locking means to be locked to the body.

According to the above configuration, the covers are locked to each other by the first locking means in a closed state, and the closed state is held. Further, the covers are locked to the body by the second locking means. Thus, even if the hinges are broken, the covers are not opened or detached from the body.

The first locking means may be provided on a tubular portion of the covers configured to cover the connecting portion. According to this configuration, the tubular portion is more difficult to open, and therefore the connecting portion can be protected more reliably protected.

According to this specification, a shield connector is obtained that suppresses the detachment of a cover even if a hinge is broken.

DETAILED DESCRIPTION

Figure 1:
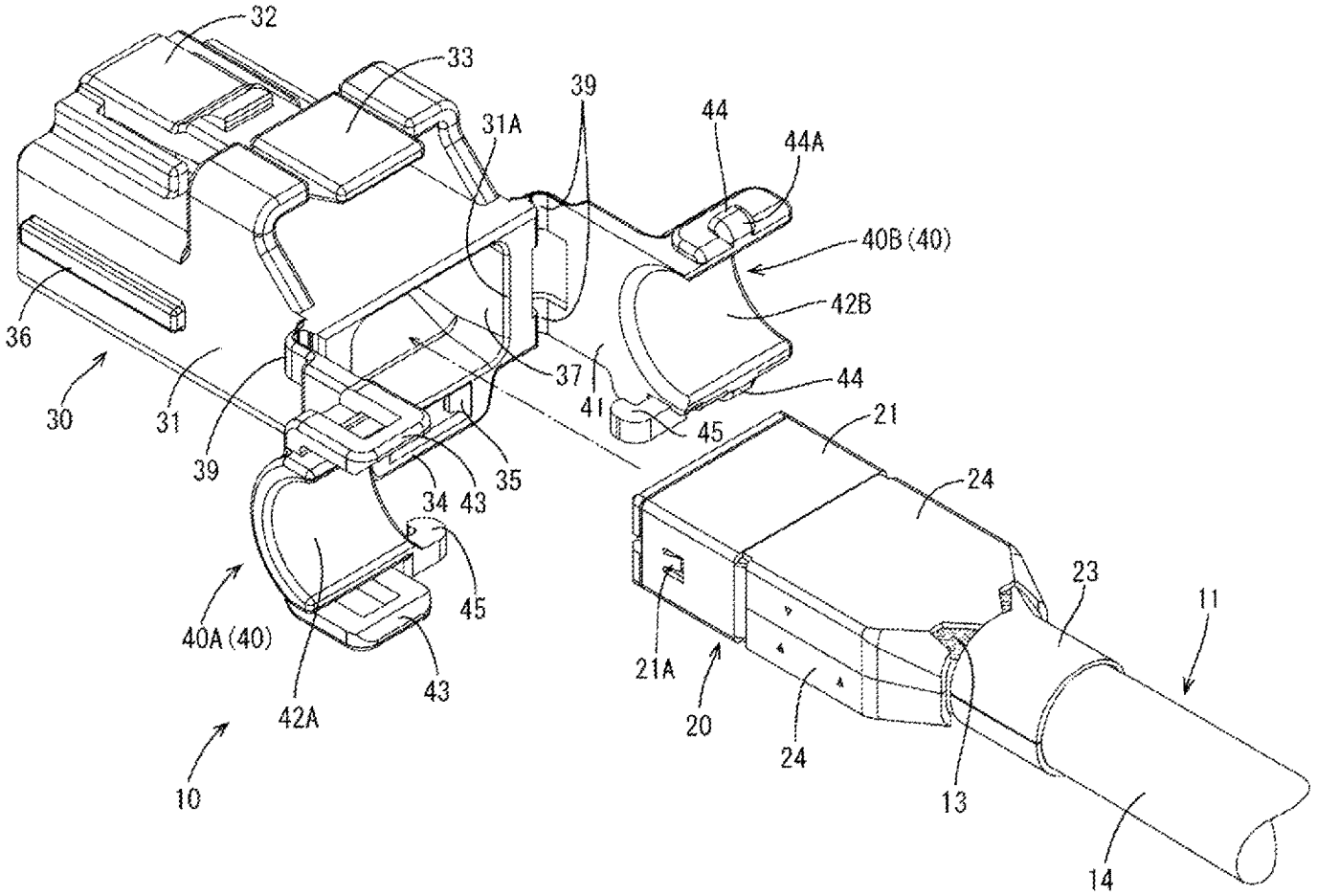
FIG. 1 is an exploded perspective view of a shield connector of one embodiment.

One embodiment is described with reference to FIGS. 1 to 12. A shield connector 10 is mounted in a vehicle such as an automotive vehicle and arranged in a wired communication path between an in-vehicle electrical component (car navigation system, ETC, monitor or the like) and an external device (camera or the like) or between in-vehicle electrical components in a vehicle. In the following description, an upper side and a lower side of FIG. 1 are referred to as an upper side and a lower side concerning a vertical direction, a left-lower side and a right-upper side of FIG. 1 are referred to as a left side and a right side concerning a lateral direction, and a left-upper side and a right-lower side of FIG. 1 are referred to as a front side and a rear side concerning a front-rear direction. Further, for a plurality of identical members, one member may be denoted by a reference sign and the other members may not be denoted.

The shield connector 10 of this embodiment includes a shielded cable 11 having wires 12 (ten in this embodiment), terminals 15 to be connected to end parts of the respective wires 12, an inner housing 16 for accommodating the terminals 15, a shield shell 20 for covering the inner housing 16 and the wires 12, and an outer housing 30 for accommodating the shield shell 20 inside (see FIG. 1).

(Shielded Cable 11)

Figure 2:
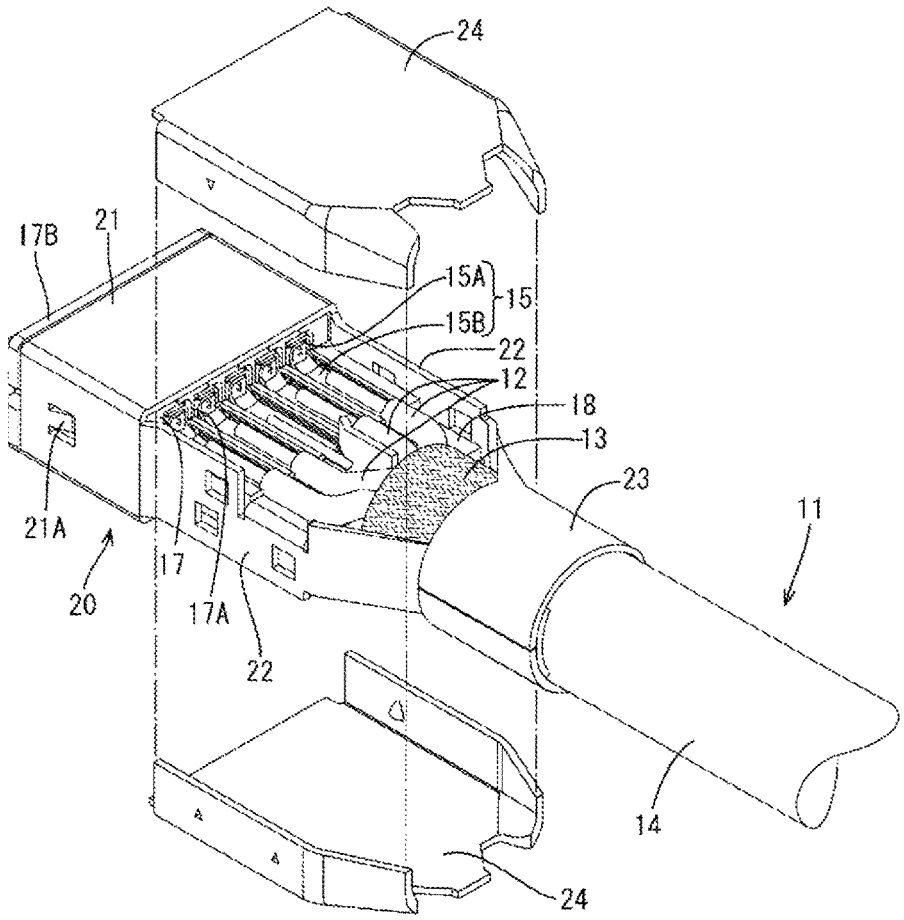
FIG. 2 is an exploded perspective view of a shield shell accommodating an inner housing, terminals and an end part of a shielded cable.
Figure 3:
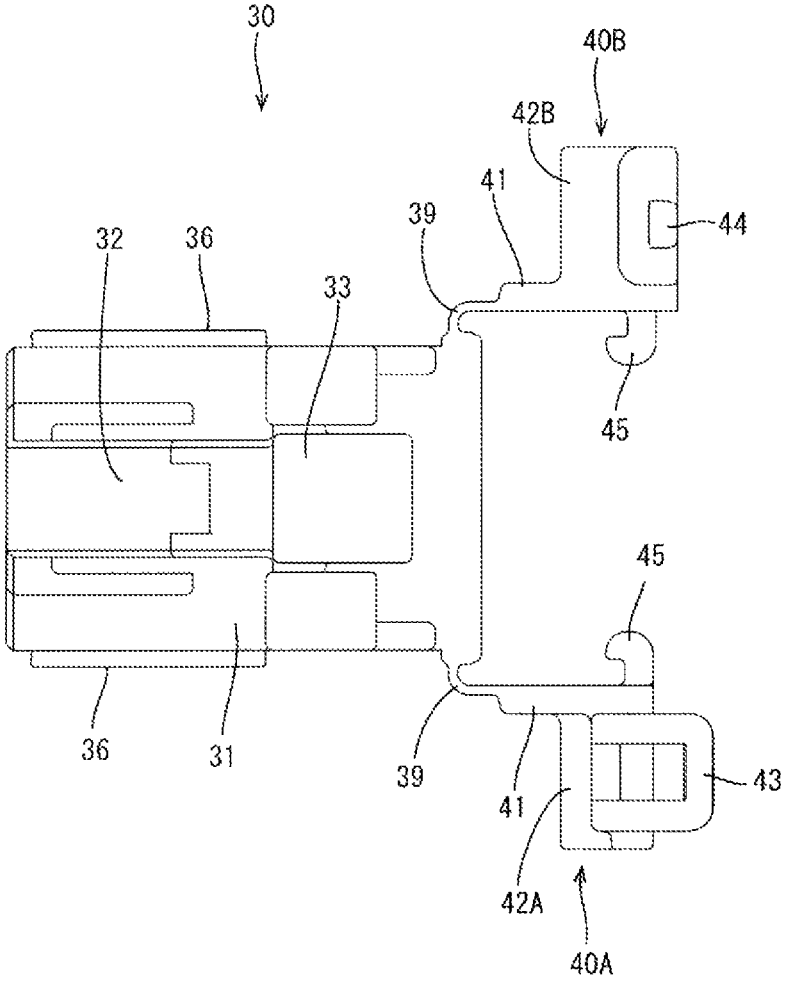
FIG. 3 is a plan view of an outer housing with a cover opened.
Figure 4:
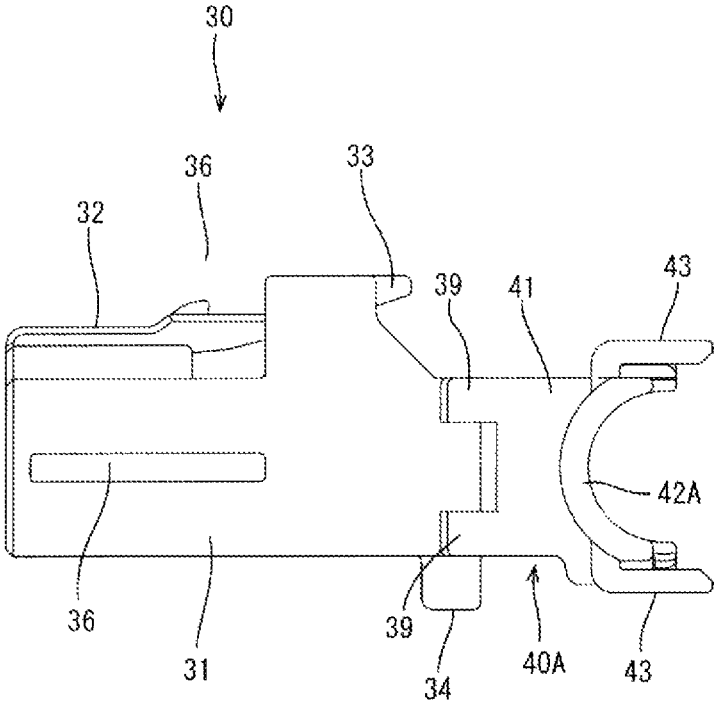
FIG. 4 is a side view of the outer housing with the cover opened.

The shielded cable 11 is capable of high speed communication of 1 GHz or faster and includes, as shown in FIG. 2, the ten wires 12. A shield layer 13 collectively encloses the wires 12 and is formed of a braided wire configured by braiding thin metal wires. An insulation coating 14 covers the outer periphery of the shield layer 13 and is made of insulation synthetic resin.

The wires 12 include two high-speed wire pairs (differential pair cables with a shield and a drain wire) as first communication wires, one wire pair (twisted pair cable without a shield) as a second communication wire having a lower maximum data transfer speed than the first communication wires, one power supply wire connected to a power supply and one ground wire connected to ground. In this embodiment, the wires 12 serving as the first communication wires are wires of USB (Universal Serial Bus) 3.0 standard, whereas the wires 12 serving as the second communication wire are wires of USB 2.0 standard.

Each wire 12 has a conductor made of a metal wire coated with an insulation layer made of insulating synthetic resin. End parts of the ten wires 12 extending forward from the ends of the shield layer 13 and the insulation coating 14 of the shielded cable 11 have the insulation layers removed. Thus, the conductors to be connected to the terminals 15 are exposed. These ten wires 12 are divided into upper and lower groups each including five wires on a leading end side, and five wires 12 are laterally arranged in a row in each of upper and lower stages, thereby configuring upper and lower wire rows.

(Terminals 15)

A front side of the terminal 15 serves as a terminal connecting portion 15A in the form of a rectangular tube to be connected to a mating male terminal, and a wire connecting portion 15B in the form of a long and narrow plate to be connected to the conductor of the wire 12 is formed integrally on a rear side of the terminal connecting portion 15A. The conductor of the wire 12 is placed on the upper surface of the wire connecting portion 15B and soldered so that the terminal 15 and the wire 12 are connected electrically.

(Inner Housing 16)

The inner housing 16 is made of insulating synthetic resin and includes a housing body 17 for accommodating the terminal connecting portions 15A of the respective terminals 15 and a housing extending portion 18 extending rearward from the housing body 17.

As shown in FIG. 2, the housing body 17 is formed into a rectangular parallelepiped shape and five cavities 17A for accommodating the terminals 15 are arranged laterally at intervals in upper and lower stages. Each cavity 17A has a rectangular cross-section corresponding to the outer peripheral shape of the terminal connecting portion 15A and extends in the front-rear direction according to a length of the terminal connecting portion 15A. A flange 17B protrudes out on the front end of the housing body 17. Further, left and right outer side surfaces of the housing body 17 are cut from the front end edges toward a rear end to form groove-like locking pieces (not shown) configured to lock locking pieces 21A of the shield shell 20 to be described later.

The housing extending portion 18 is in the form of a plate extending rearward from a vertically central part (between the cavities 17 in the upper and lower stages) on the rear end of the housing body 17. A front side of the housing extending portion 18 serves as a terminal placing portion that forms grooves arranged in the lateral direction and on which the wire connecting portions 15B of the respective terminals 15 are to be placed, and a rear side serves as a substantially planar wire placing portion.

(Shield Shell 20)

The shield shell 20 is formed by applying punching and bending to a metal plate material, such as aluminum, aluminum alloy, copper or copper alloy, and includes, as shown in FIG. 2, a housing enclosing portion 21 in the form of a rectangular tube enclosing the housing body 17 of the inner housing 16, two shield extending portions 22 extending rearward from left and right side walls of the housing enclosing portion 21, a fastening portion 23 (an example of a connecting portion) extending rearward from the rear ends of the shield extending portions 22, and two shell covers 24 for covering an open part open in the vertical direction from above and below between the housing enclosing portion 21 and the fastening portion 23.

Parts of a pair of left and right side walls of the housing enclosing portion 21 are cut and bent inwardly, thereby forming the locking pieces 21A to be locked to the unillustrated locking portions of the housing body 17. When the inner housing 16 is inserted and fit from front of the housing enclosing portion 21, the locking pieces 21A are locked to the locking portions of the housing body 17 to retain the housing body 21 in the housing enclosing portion 21.]

Further, by fastening the fastening portion 23 to the shielded cable 111, the shielded cable 11 is held in the shield shell 20. Note that the fastening portion 23 also functions as a shield connecting portion to be connected to the shield layer 13 folded outwardly of the insulation coating 14 at an end part of the shielded cable 11.

(Outer Housing 30)

The outer housing 30 is made of insulating synthetic resin and includes, as shown in FIGS. 1 and 3 to 5, a body 31 in the form of a substantially rectangular tube and two covers 40 provided via hinges 39 near the rear end of the body 31.

The body 31 includes a shield accommodating chamber 37 that receives the shield shell 20 accommodating the inner housing 16 and the end part of the shielded cable 11. The shield shell 20 is inserted into the shield accommodating chamber 37 through an opening 31A on a rear side of the body 31.

A lock arm 32 is cantilevered rearward on a front side of the upper surface of the body 31 and locks a receptacle of a mating connector (not shown) to be connected from the front. An unlocking portion 33 is integral to the lock arm 32 and stands up on a leading end side (rear side in FIG. 1) of this lock arm 32. Further, two guiding ribs 36 extend in a connecting direction (front-rear direction) on left and right side surfaces of the body 31 for guiding a connection posture of the mating connector.

Each of the covers 40 is integral to the body 31 via hinges 39 that extend out on upper and lower ends near the rear end of the left or right side wall of the body 31. The cover 40 coupled to the left side wall of the body 31 is referred to as a first cover 40A and the cover 40 coupled to the right side wall is referred to as a second cover 40B below.

Figure 8:
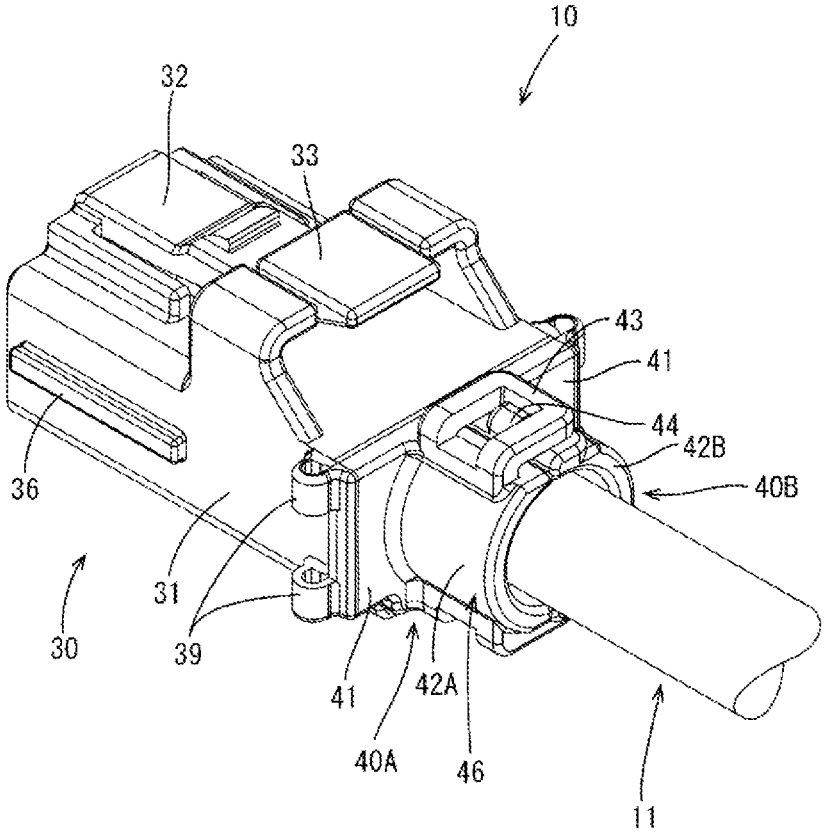
FIG. 8 is a perspective view of the outer housing with the cover closed.

The cover 40 includes a back surface covering portion 41 in the form of a flat plate for covering the opening 31A on the rear of the body 31 except a part where the shielded cable 11 is passed and a wire cover 42 extending out (rearward) from a plate surface of the back surface covering portion 41 and covering the shielded cable 11 and the fastening portion 23 along the outer peripheries of those with the cover 40 closed (see FIG. 8). Each wire covering portion 42 is in the form of a curved wall having a substantially semicircular cross-section. End edges of the wire covering portions 42 are butted against each other, thereby forming a tubular portion 46 in the form of a cylindrical tube that extends in the front-rear direction and through which the shielded cable 11 is passed. The wire covering portion 42 of the first cover 40A is referred to as a first wire covering portion 42A and the wire covering portion 42 of the second cover 40B is referred to as a second wire covering portion 42B below.

With the pair of covers 40 closed, the tubular portion 46 (pair of wire covering portions 42) has a length to cover at least a part of the fastening portion 23 exposed from the body 31 (shell accommodating chamber 37). Further, an inner diameter of the tubular portion 46 with the covers 40 closed is equal to or slightly larger than an outer diameter of the fastening portion 23 fastened to the shielded cable 11.

The covers 40 are provided with locking means for locking the mating covers 40. Specifically, two U-shaped locking pieces 43 (an example of a first locking means) are provided on the upper and lower ends of the outer peripheral surface of the first wire covering portion 42A and stand outward and extend toward the second cover 40B with the covers 40 closed.

On the other hand, two locking protrusions 44 (an example of the first locking means) are provided on the upper and lower ends of the outer peripheral surface of the second wire covering portion 42B and are lockable to the locking pieces 43 with the pair of covers 40 closed. The locking pieces 43 and locking protrusions 44 are locked to each other so that the first and second covers 40A, 40B are held in a mutually closed state (see FIGS. 8 to 12). Note that a corner part of the locking protrusion 44 on the side of the first cover 40A is cut obliquely to form a guiding surface 44A.

Figure 9:
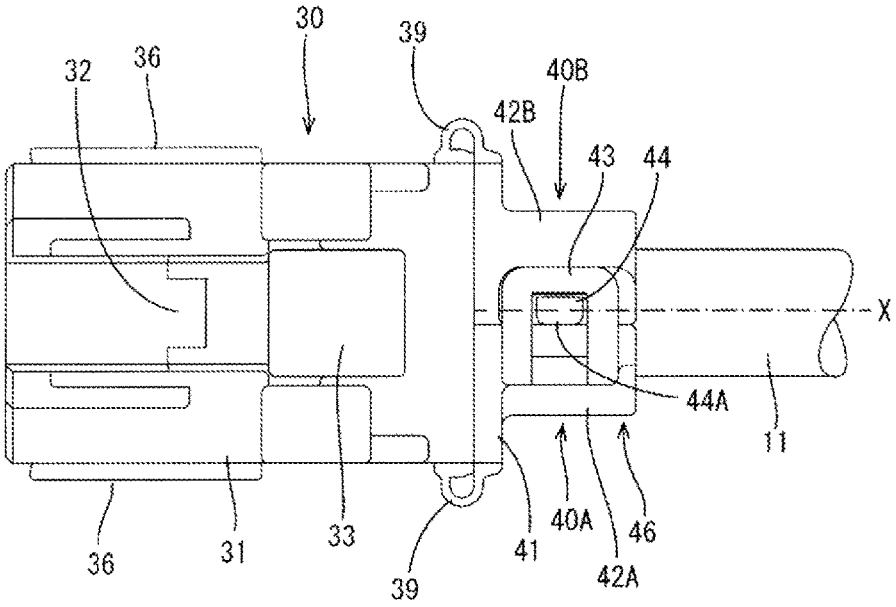
FIG. 9 is a plan view of the outer housing with the cover closed.
Figure 10:
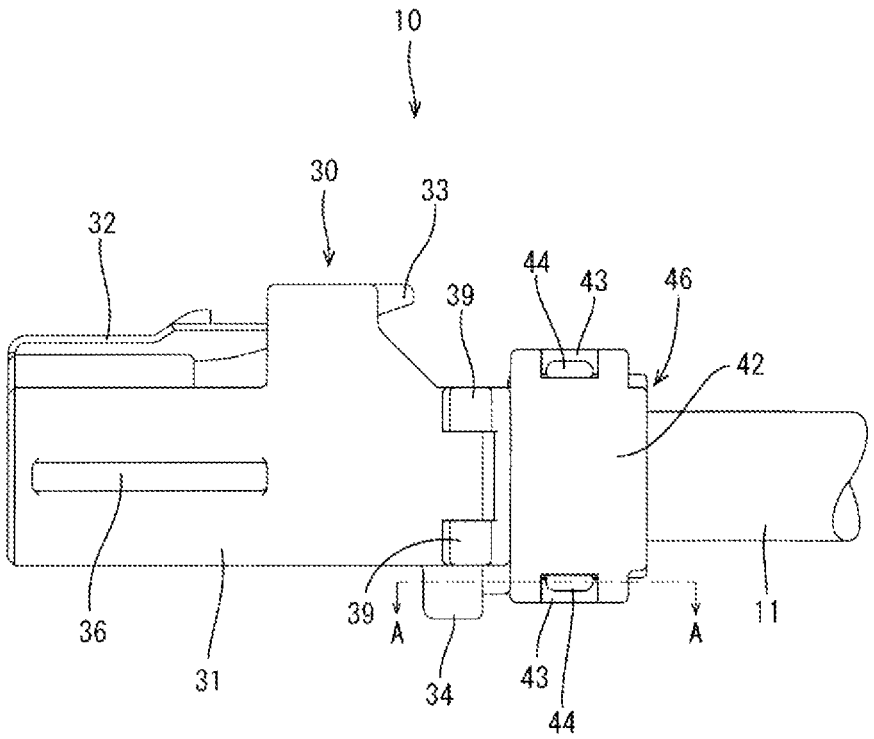
FIG. 10 is a side view of the outer housing with the cover closed.

In this embodiment, the second wire covering portion 42B is somewhat larger than the first wire covering portion 42A. More specifically, as shown in FIG. 9, the first and second wire covering portions 42A, 42B are not being divided along a center line X in the lateral direction (vertical direction of FIG. 9) of the tubular portion 46, but are divided at a position to the left of (in FIG. 9, lowered than) the center line X. This causes a butting surface of the second wire covering portion 42B against the first wire covering portion 42A to be left of the center line X with the covers 40 closed, and the locking protrusions 44 overlap on this center line X. In other words, the locking protrusions 44 are provided on the center line X of the tubular portion 46. That the locking protrusions 44 are provided on the center line X means both that centers of the locking protrusions 44 coincide with the center line X and these centers are slightly deviated from the center line X.

The covers 40 are provided with locking claws 45 (an example of a second locking means) for locking the body 31 with the covers 40 closed. The locking claw 45 is substantially L-shaped by extending forward from an end part of the lower end of each wire covering portion 42 on the side of the back surface covering portion 41 and are bent out in the lateral direction (see FIG. 11) with the covers 40 closed. Note that an outer corner part of the locking claw 45 in a bending direction is chamfered into a curved surface.

On the other hand, the body 31 has a bulging portion 34 extending in a width direction (lateral direction), bulging down and open rearward on a rear end part of a bottom wall. Two locking protrusions 35 to be locked to the locking claws 45 of the covers 40 are provided inside this bulging portion 34. The locking protrusions 35 are provided at positions symmetrical with respect to the center line in the width direction (lateral direction) of the body 31.

Figure 5:
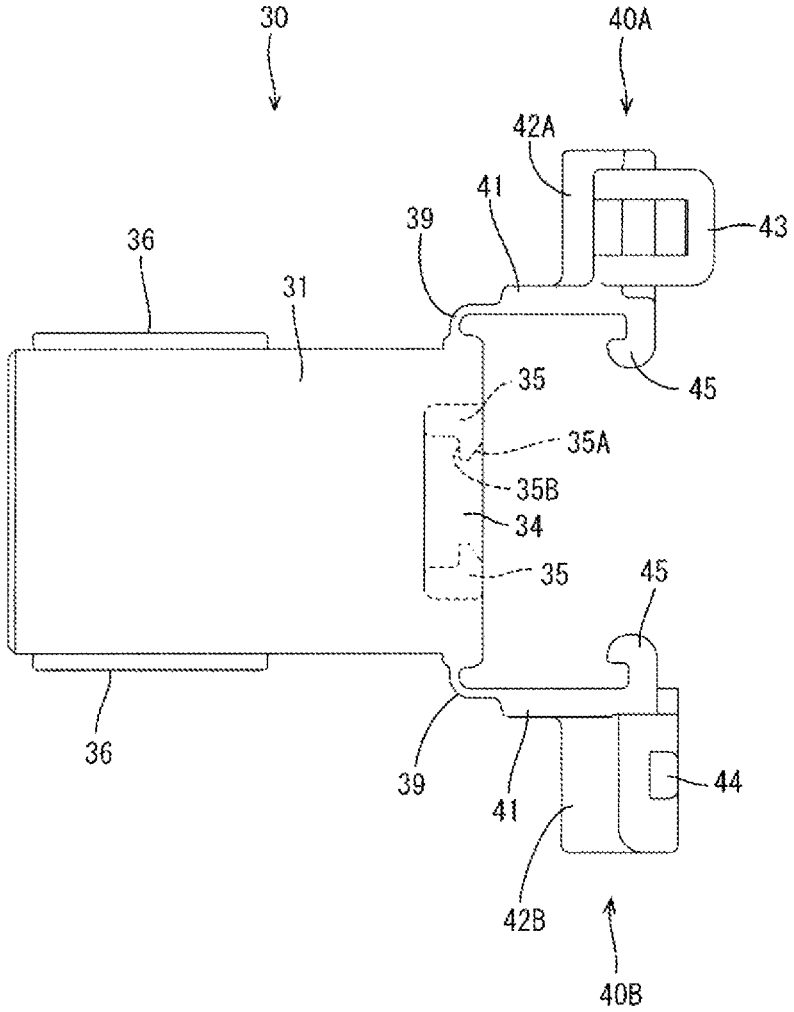
FIG. 5 is a bottom view of the outer housing with the cover opened.
Figure 6:
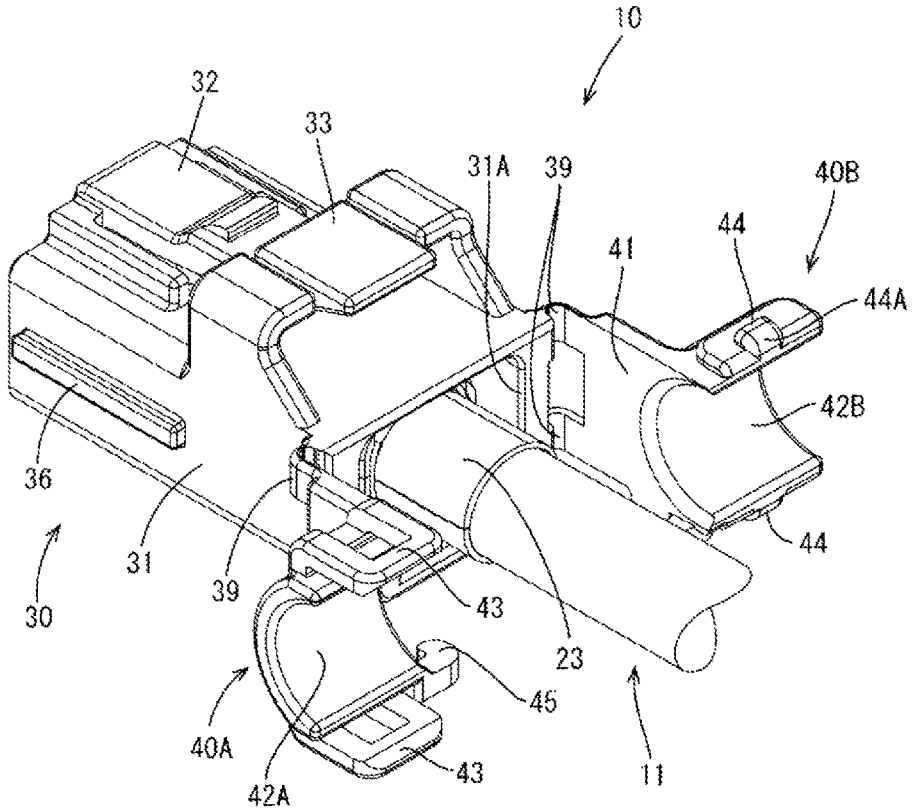
FIG. 6 is a perspective view of the outer housing with the shield shell accommodated therein.
Figure 7:
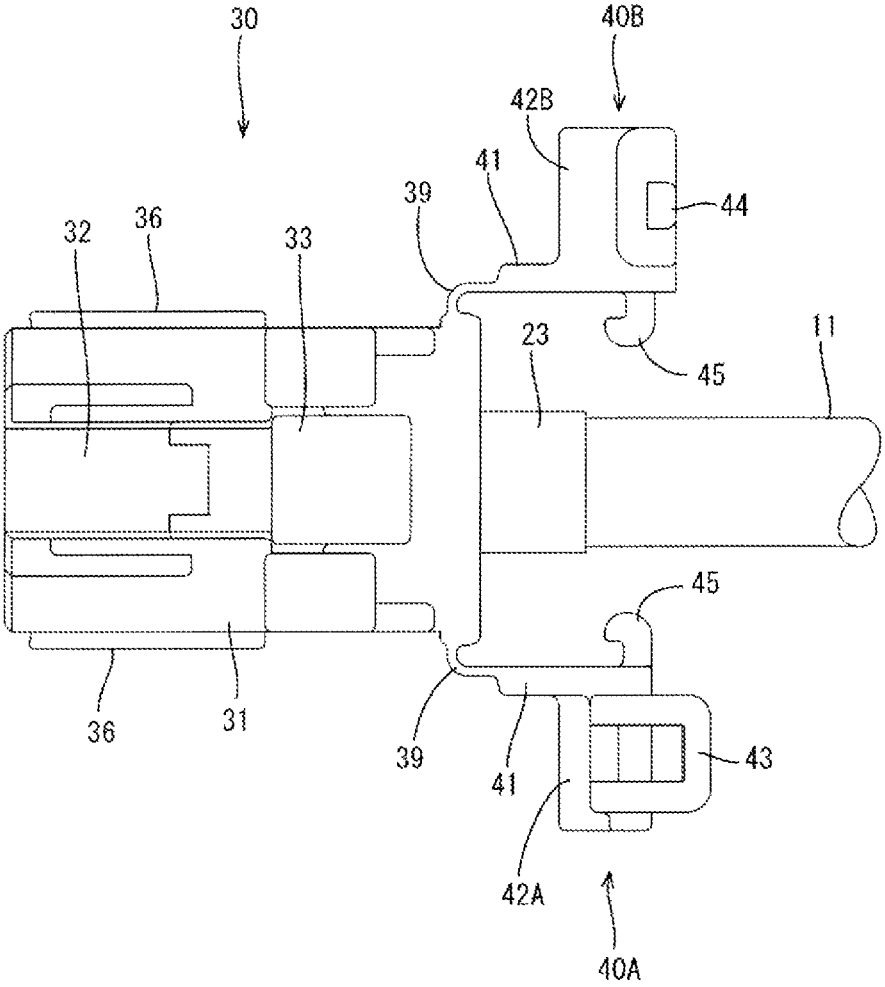
FIG. 7 is a plan view of the outer housing with the shield shell accommodated therein.
Figure 11:
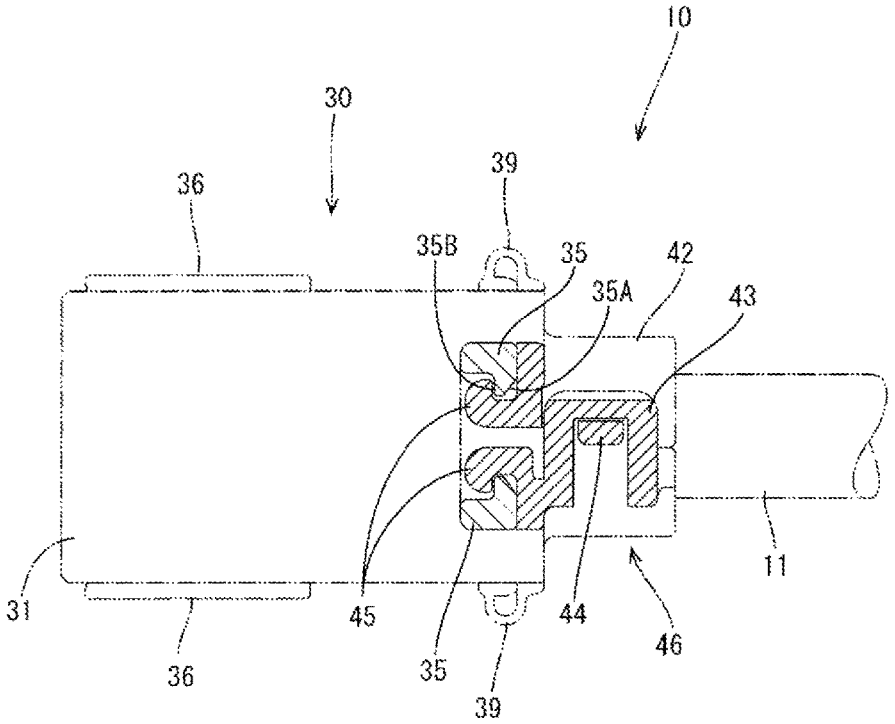
FIG. 11 is a section along A-A of FIG. 10.
Figure 12:
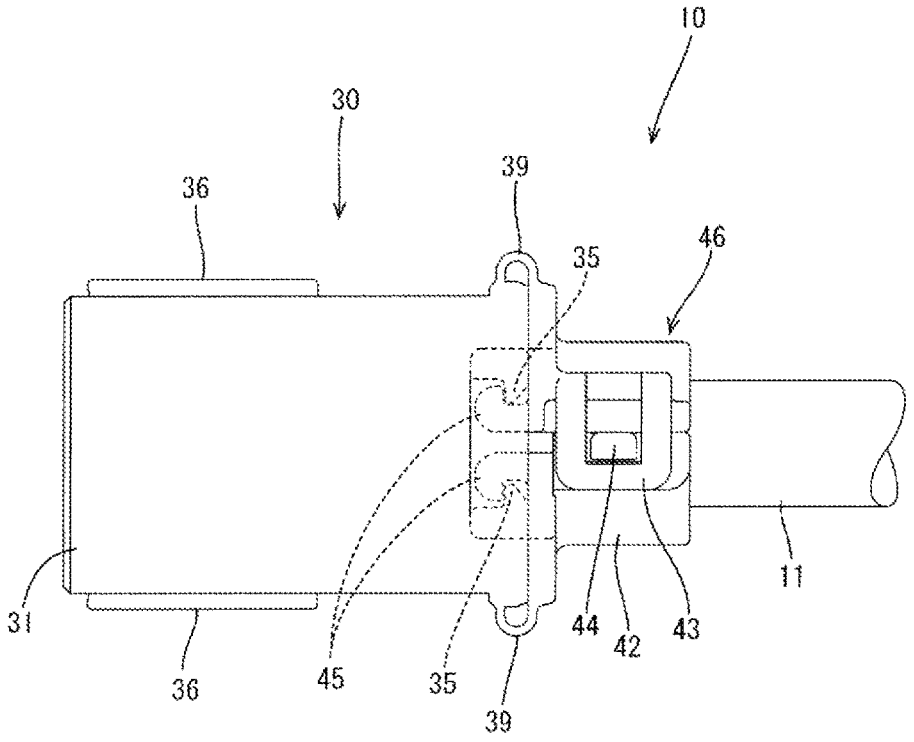
FIG. 12 is a bottom view of the outer housing with the cover closed.

As shown in FIGS. 1 and 5, the two locking protrusions 35 project from left and right side walls of the inner wall of the bulging portion 34 toward the facing side walls, and have guiding surfaces 35A oblique to a mutually approaching direction from a rear side toward a front side, front corner parts thereof are cut orthogonally to form steps 35B, and the locking claws 45 are locked to these steps 35B (see FIG. 11).

Next, how to assemble the shield connector 10 of this embodiment is described. In assembling the shield connector 10, the shield shell 20 accommodating the inner housing 16 and the end part of the shielded cable 11 inside is inserted forward through the opening 31A on the rear side of the outer housing 30 (see FIG. 1). The shield shell 20 is inserted to a predetermined position of the shell accommodating chamber 37 and held at the predetermined position by an unillustrated locking means. In this state, a part of the fastening portion 23 of the shield shell 20 projects rearward from the rear end of the body 31 (shell accommodating chamber 37) (see FIGS. 6 and 7).

Subsequently, the first and second covers 40A, 40B are rotated about the hinges 39 to be closed. As these covers 40 are rotated, the locking pieces 43 of the first cover 40A approach the locking protrusions 44 of the second cover 40B and gradually resiliently deform out by the guiding surfaces 44A of the locking protrusions 44. At the same time as the covers 40 are closed completely, the locking pieces 43 move over the locking protrusions 44 and resiliently return. In this way, the locking pieces 43 and the locking protrusions 44 are locked and the first and second covers 40A, 40B are locked in a mutually closed state (see FIGS. 8 to 12).

On the other hand, simultaneously with this, the two locking claws 45 of the covers 40 enter the bulging portion 34 of the body 31 and are resiliently deformed in directions toward each other by the guiding surfaces 35A of the locking protrusions 35 as the covers 40 are rotated. At the same time as the covers 40 are closed completely, the locking claws 45 move over the guiding surfaces 35A and resiliently return. In this way, the locking claws 45 are locked to the steps 35B of the locking protrusions 35 and each cover 40 is held on the body 31.

Further, the opening 31A of the body 31 is covered by the back surface covering portions 41 and the fastening portion 23 is covered by the tubular portion 46 in such a state where the covers 40 are closed completely and held, with the result that the entire shield shell 20 is covered by the outer housing 30.

According to this embodiment, the covers 40 in the closed state are locked to each other by the locking pieces 43 and the locking protrusions 44, and this closed state is held. Further, the covers 40 are locked respectively to the body 31 by the locking claws 45 locking the locking protrusions 35. Thus, even if the hinges 39 are broken, the covers 40 are not likely to be opened or detached from the body 31.

Further, since the locking pieces 43 and the locking protrusions 44 are provided on the tubular portion 46 of the covers 40 for covering the fastening portion 23, the fastening portion 23 can be protected more reliably by the tubular portion 46. Further, the fastening portion 23 can be electrically insulated by the tubular portion 46.

The specification is not limited to the above described and illustrated embodiment. For example, the following embodiments also are included in the scope of the invention.

The locking pieces 43 and the locking protrusions 44 are provided in the above embodiment. However, each of the locking piece 43 and the locking protrusion 44 may be provided at one position.

Further, a pair of the locking claw 45 and the locking protrusion 35 may be provided.

Although the locking pieces 43 and the locking protrusions 44 are provided on the wire covering portions 42 of the tubular portion 46 in the above embodiment, they may be provided on the back surface covering portions 41.

Further, these locking means are not limited to the locking pieces, the locking claws and the locking protrusions and can be appropriately changed.

Although the first and second wire covering portions 42A, 42B differ in size in the above embodiment, they may have the same size. Further, the disposed positions of the locking protrusions 44 and the locking pieces 43 are also not limited to those of the above embodiment.

LIST OF REFERENCE SIGNS

10: shield connector
11: shielded cable
12: wire
13: shield layer
14: insulation coating
15: terminal
16: inner housing
23: fastening portion (connecting portion)
20: shield shell
30: outer housing
31: body portion
31A: opening
35: locking protrusion
39: hinge
40A: first cover (cover)
40B: second cover (cover)
41: back surface covering portion
42: wire covering portion
43: locking piece (first locking means)
44: locking protrusion (first locking means)
45: locking claw (second locking means)
46: tubular portion

The invention claimed is:

1. A shield connector, comprising:

a shielded cable including wires collectively enclosed by a metal shield layer and an insulation coating covering an outer periphery of the metal shield layer;

an inner housing formed from an insulating synthetic resin and configured to accommodate terminals connected to the wires inside;

a shield shell formed from a metal material and configured to cover the inner housing and including a connecting portion to be electrically connected to the shield layer of the shielded cable exposed on an end part; and an outer housing formed from an insulating synthetic resin and configured to accommodate the shield shell inside and to be locked to a mating connector, wherein:

the outer housing includes a body enabling the shield shell to be inserted therein through an opening on a rear side in a connecting direction to the mating connector, and first and second covers integrally provided at opposite first and second sides of the body via substantially parallel first and second hinges respectively and configured to rotate toward one another to close the opening and to cover the connecting portion; and each of the covers includes a first locking means to be locked to the other of the covers when the covers are closed and a second locking means to be locked to the body when the covers are closed.

2. The shield connector of claim 1, wherein the covers form a tubular portion when the covers are closed and the first locking means is provided on parts of the covers that form the tubular portion, and the tubular portion formed by the covers is configured to cover the connecting portion.

3. A shield connector, comprising:

an inner housing formed from an insulating synthetic resin;

a shielded cable including wires collectively enclosed by a metal shield layer and an insulation coating covering an outer periphery of the metal shield layer;

terminals connected to the wires and accommodated in the inside the inner housing;

a shield shell formed from an insulating synthetic resin and covering the inner housing, the shield shell including a connecting portion electrically connected to the metal shield layer of the shielded cable exposed on an end part of the shielded cable; and an outer housing formed from an insulating synthetic resin, the outer housing accommodating the shield shell inside and configured to be locked to a mating connector, the outer housing including a body having an opening on a rear side in a connecting direction to the mating connector and enabling the shield shell to be inserted therein through, and first and second covers integrally provided on the body via first and second hinges and configured to rotate toward one another to close the opening and to cover the connecting portion, each of the covers including a first locking means to be locked to the other of the covers and a second locking means to be locked to the body.

4. The shield connector of claim 3, wherein the covers form a tubular portion when the covers are closed and the first locking means is provided on parts of the covers that form the tubular portion, and the tubular portion formed by the covers is configured to cover the connecting portion.

* * * * *